US006614339B2

(12) United States Patent
Parry et al.

(10) Patent No.: US 6,614,339 B2
(45) Date of Patent: Sep. 2, 2003

(54) EXHAUST CONTROL DEVICE FOR USE WITH CIRCUIT INTERRUPTER

(75) Inventors: Robert Neville Parry, Beaver, PA (US); Richard Craig Alexander, Cranberry Township, PA (US); James Jeffery Benke, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 20 days.

(21) Appl. No.: 09/919,474

(22) Filed: Jul. 31, 2001

(65) Prior Publication Data

US 2003/0025586 A1 Feb. 6, 2003

(51) Int. Cl.[7] ..... H01H 85/38
(52) U.S. Cl. ..... 337/273; 337/280; 337/282
(58) Field of Search ..... 337/273, 280, 337/282, 142, 227

(56) References Cited

U.S. PATENT DOCUMENTS 3,391,368 A 7/1968 Fahnoe
3,719,912 A 3/1973 Harner et al.
3,965,452 A 6/1976 Chabala et al.
4,001,750 A 1/1977 Scherer et al.
4,158,830 A 6/1979 Biller et al.
4,788,519 A 11/1988 Swanson

*Primary Examiner*—Jayprakash N. Gandhi
(74) *Attorney, Agent, or Firm*—Martin J. Moran

(57) ABSTRACT

An exhaust control device for use with a circuit interrupter includes a casing having a first expansion chamber and a second expansion chamber that are operationally disposed upstream of a heat sink and a damper, with the second expansion chamber being in fluid communication with the first expansion chamber and being in register with an inlet of the casing. The first expansion chamber extends between the inlet and the heat sink. The heat sink is a porous member that is annular in cross-section and includes a central cavity formed therein, the second expansion chamber being disposed in the central cavity. The first and second expansion chambers are configured to separate a blast of gases from the circuit interrupter into first and second pressure waves that sequentially travel through the heat sink and the damper, which reduces the peak intensity of the blast, extends its duration, and reduces its ionization level.

7 Claims, 3 Drawing Sheets

EXHAUST CONTROL DEVICE FOR USE WITH CIRCUIT INTERRUPTER

BACKGROUND OF THE INVENTION

1. Field of the Invention

The present invention relates generally to power distribution machinery and, more particularly, to circuit interrupters. More specifically, the present invention relates to an exhaust control device for use with a circuit interrupter.

2. Description of the Related Art

As is understood in the relevant art, numerous types of circuit interrupters are known and are employed for various purposes including the protection of electrical circuits. Among the various types of circuit interrupters are circuit breakers and fuses. Circuit breakers are more or less permanent components of an electrical circuit since they can be easily returned to an "on" condition to permit the flow of current therethrough after a condition which has caused the circuit breaker to trip has been removed from the circuit. In contrast thereto, fuses typically must be replaced after the occurrence of an electrical event which causes the fuse to perform its circuit protection function.

Fuses generally include some type of fusing conductor that fuses or melts in the event of one or more certain specified conditions from which a circuit is desired to be protected. Fuses that are employed in medium voltage circuits such as 17 kV, 27 kV, 38 kV, and higher must be specially designed to extinguish any arcs that may propagate between the conductors that had previously been electrically connected with one another via the fusing element. One type of high voltage fuse employs a loaded spring connected with an arcing rod that cooperate to elongate the arc through a boric acid chamber upon melting of the fuse element. At high temperatures, boric acid disassociates and produces a blast of water vapor and inert boric anhydride. Electrical interruption is caused by the steam extinguishing the arc as the arc is being elongated through the cylinder. High particle turbulence of the boric acid products causes the rate of deionization within the fuse to exceed the ionization of the electrical arc, which results in rapid extinction of the arc. However, the blast of water vapor and boric anhydride exits the fuse at an extremely elevated temperature and velocity and thus has the capacity to burn materials in the immediately surrounding environment and additionally results in a loud noise.

As such, it is known to provide an exhaust control device through which the blast of water vapor and boric anhydride must pass before being discharged into the environment. Such exhaust control devices typically have included deionizing heat sinks and dampers of various configurations that reduce the temperature and the velocity of the blast gases prior to their discharge into the atmosphere. One example of such an exhaust control device is a muffler.

While such exhaust control devices have been generally effective for their intended purposes, such exhaust control devices have not, however, been without limitation. As is understood in the relevant art, such exhaust control devices can theoretically be configured to be sufficiently large and complex to reduce the temperature of the exiting gases to be near ambient temperature and can reduce the velocity of the blast gases to near zero. However, such a hypothetical exhaust control device would be extremely expensive to produce and would occupy an unduly large space. Moreover, it is necessary only to reduce the temperature, velocity, and ionization level of the blast gases to levels that make the blast gases less harmful to the surrounding environment. It is thus desired to provide an exhaust control device that is relatively small and inexpensive to manufacture yet reliably reduces the temperature and velocity of the exiting gases to non-dangerous levels. It is thus preferred that such an exhaust control device maximize the efficiency with which its heat sink and damper operate on the blast gases passing therethrough. Such an improved exhaust control device preferably would include multiple expansion chambers that would reduce the peak intensity of the blast within the exhaust control device and extend the duration over which the heat sink and the damper can remedially operate on the blast.

SUMMARY OF THE INVENTION

In view of the foregoing, an exhaust control device for use with a circuit interrupter includes a casing having a first expansion chamber and a second expansion chamber that are operationally disposed upstream of a heat sink and a damper, with the second expansion chamber being in fluid communication with the first expansion chamber and being in register with an inlet of the casing. The first expansion chamber extends generally between the inlet and the heat sink. The heat sink is a porous member that is generally annular in cross-section and includes a central cavity formed therein, the second expansion chamber being generally disposed in the central cavity. The first and second expansion chambers are advantageously configured to separate a blast of gases from the circuit interrupter into a first pressure wave and a second pressure wave that sequentially travel through the heat sink and the damper, which reduces the peak intensity of the blast, extends its duration, and reduces its ionization level, with the advantageous result that a relatively smaller heat sink can be employed therein.

An aspect of the present invention is to provide an exhaust control device of a relatively small size.

Another aspect of the invention is to provide an exhaust control device having multiple expansion chambers therein for reducing the peak intensity of a blast of gases from a circuit interrupter.

Another aspect of the present invention is to provide an exhaust control device having a first expansion chamber substantially interposed between an inlet and a heat sink of the exhaust control device, and additionally includes a second expansion chamber that is aligned with the inlet, whereby a meaningful portion of a blast of gases being received through the inlet will be directly received in the second expansion chamber to reduce the peak intensity of the blast gases passing through the heat sink.

Another aspect of the present invention is to provide an exhaust control device that can be manufactured relatively less expensively without reducing the overall effectiveness thereof.

Another aspect of the present invention is to provide an exhaust control device that reduces the temperature, velocity, and ionization level and of gases produced in a circuit interrupter upon interruption of a circuit.

Accordingly, an aspect of the present invention is to provide an exhaust control device for use in conjunction with a circuit interrupter, in which the general nature of the exhaust control device can be stated as including a casing having an interior and including an inlet and an outlet in flow communication with the interior, with the inlet being structured to be connected in fluid communication with the circuit interrupter, a support apparatus disposed within the interior, a wall disposed within the interior of the casing and mounted on the support apparatus, a porous heat sink disposed within the interior of the casing between the inlet and the outlet and extending at least partially around the wall between the wall and the casing, with the heat sink being structured to permit the flow of fluid therethrough, a first expansion chamber disposed within the interior at least partially between the inlet and the heat sink, the first expansion chamber having a greater cross-sectional area than the inlet, and a second expansion chamber defined by the wall and in fluid communication with the first expansion chamber, the second expansion chamber having a mouth that is in register with at least a portion of the inlet.

The second expansion chamber of such an exhaust control device may be centrally disposed within the heat sink.

The support apparatus may include a perforated upstream plate and a perforated downstream plate, with the wall and the heat sink being substantially interposed between the upstream and downstream plates. In such an exhaust control device, the support apparatus may additionally include a fastener that extends between the upstream and downstream plates and extends through the expansion chamber. Alternately, or in addition thereto, the downstream plate may include a non-perforated portion that is engaged with the wall and that at least partially defines the second expansion chamber, with the non-perforated portion being disposed opposite the mouth of the second expansion chamber.

Still another aspect of the present invention is to provide an exhaust control device for use in conjunction with a circuit interrupter, in which the general nature of the exhaust control device can be stated as including a casing having an interior and including an inlet and an outlet in flow communication with the interior, with the inlet being structured to be connected in fluid communication with the circuit interrupter, a support apparatus disposed within the interior of the casing, a porous heat sink disposed within the interior of the casing between the inlet and the outlet, with the heat sink being structured to permit the flow of fluid therethrough, a first expansion chamber disposed within the interior at least partially between the inlet and the heat sink, and a second expansion chamber disposed inside the heat sink and being in fluid communication with the first expansion chamber. The second expansion chamber may include a mouth that is in register with at least a portion of the inlet.

Such an exhaust control device may include a heat sink that is substantially annular in cross-section and is formed with a substantially cylindrical central cavity, with the second expansion chamber being disposed in the central cavity. Additionally, the support apparatus may include an annular wall disposed within the central cavity, with the second expansion chamber being disposed within the wall. Additionally, the wall may extend about a central axis, whereby the central axis extends through the inlet of the exhaust control device.

BRIEF DESCRIPTION OF THE DRAWINGS

A further understanding of the invention can be gained from the following description of the preferred embodiment when read in conjunction with the accompanying drawings in which.

Similar numerals refer to similar parts throughout the specification.

DESCRIPTION OF THE PREFERRED EMBODIMENT

Figure 1:
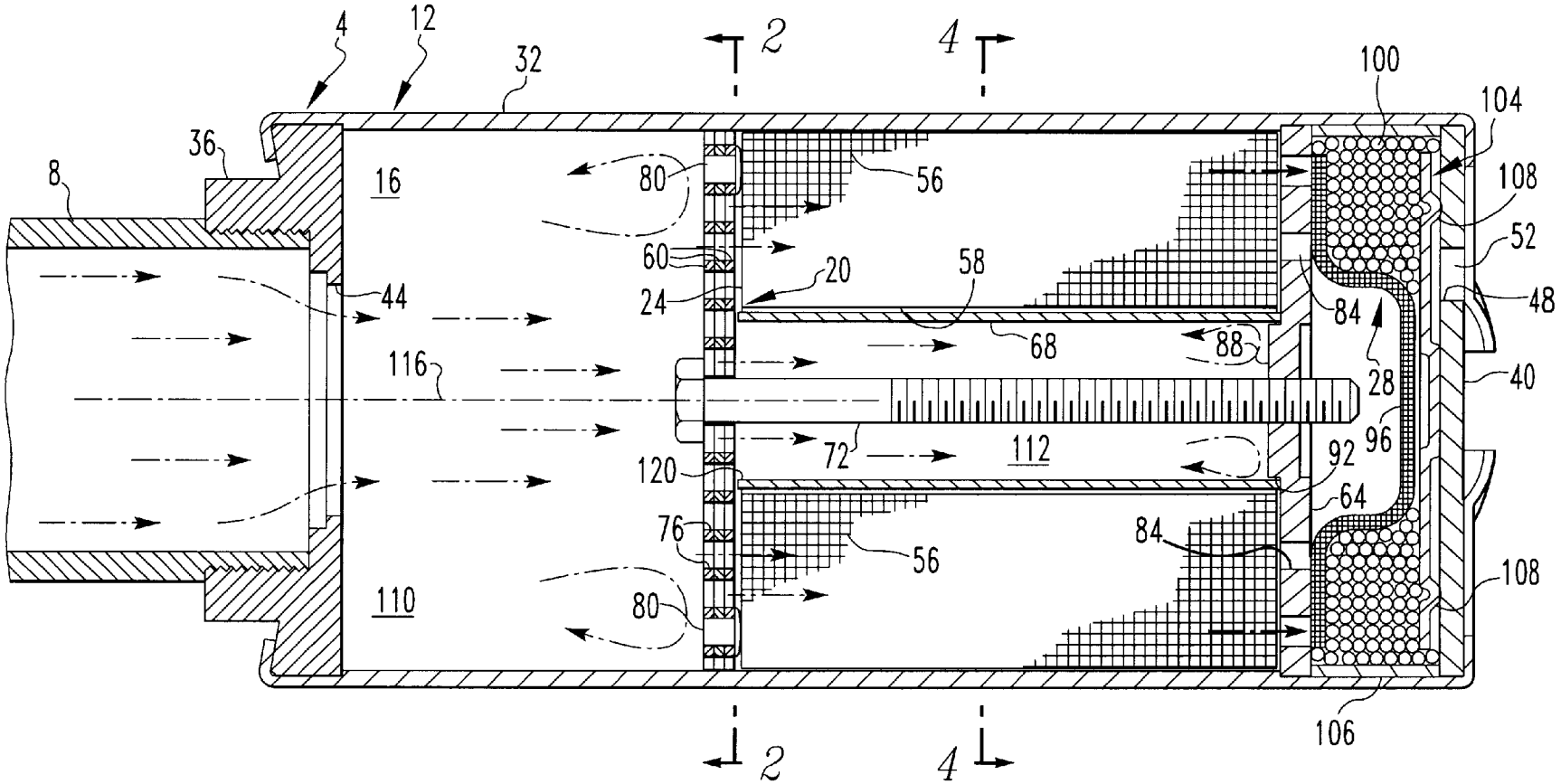
FIG. 1 is a side elevational, view partially cut away, of an exhaust control device in accordance with the present invention being mounted on a circuit interrupter.

An exhaust control device 4 in accordance with a present invention is indicated generally in FIGS. 1–4. The exhaust control device 4 is configured to work cooperatively with a circuit interrupter 8 (FIG. 1) to beneficially reduce the temperature, velocity, and ionization level of a blast of gases that is produced by the circular interrupter 8 under specified conditions. The circuit interrupter 8 may be any of a wide variety of known circuit interrupters and may particularly be in the form of a fuse having a metallic element that melts under certain specified conditions and that resultingly produces a blast of water vapor and inert boric anhydride. As will be set forth more fully below, the exhaust control device 4 is advantageously configured to be small without reducing its effectiveness.

The exhaust control device 4 can be generally stated as including a hollow casing 12 having an interior 16, with a support apparatus 20, a heat sink 24, and a damper 28 being disposed within the interior 16 of the casing 12. The casing 12 is configured to retain the aforementioned components within the interior 16 and to withstand the energy of the blast of gases that may be produced by the circuit interrupter 8.

The casing 12 includes a sidewall 32, an inlet plug 36, and an outlet plug 40 connected with one another. The sidewall 32 is generally cylindrical in shape, and the opposite ends of the sidewall 32 are bent or otherwise formed to retain the inlet and outlet plugs 36 and 40 thereon and to retain the support apparatus 20, the heat sink 24, and the damper 28 therein.

The inlet plug 36 is a disk-shaped plate that includes an inlet 44 in the form of an orifice formed generally centrally therein. The outlet plug 40 is similarly a disk-shaped plate that includes an outlet 48 which is defined by a plurality of discharge holes 52 formed in the outlet plug 40. As will be set forth more fully below, the blast of gases produced by the circuit interrupter 8 enter the inlet 44 and are discharged out of the outlet 48, with both the temperature and the velocity of the blast gases being reduced prior to exiting out of the outlet 48.

The heat sink 24 is a porous member that substantially reduces the temperature and ionization level of the blast of gases that flows therethrough. The heat sink 24 is manufactured generally out of a copper or other mesh 56 that is wrapped or otherwise formed into a configuration that is substantially annular in cross-section (FIG. 4) and that is thus formed to include a substantially cylindrical central cavity 58. The mesh 56 of the heat sink 24 is formed with a plurality of pores that permit the blast gases to flow therethrough. As such, the heat sink 24 can be characterized as being generally porous and thus permitting the flow of a fluid therethrough.

The support apparatus 20 includes a plurality of upstream plates 60, a downstream plate 64, a substantially annular wall 68, and a fastener 72. The exhaust control device 4 can be generally stated as having a flow direction from the inlet 44 toward the outlet 48, and thus the upstream plates 60 are disposed upstream of the downstream plate 64.

The upstream plates 60 (FIG. 2) are each formed with a plurality of holes 76. The holes 76 of the upstream plates 60 are aligned with one another, and the upstream plates 60 are fastened and aligned with one another by a plurality of rivets 80 that extend through some of the holes 76 of the upstream plates 60.

As can be seen in FIG. 1, the exhaust control device 4 is configured to include three of the upstream plates 60 aligned with one another and fastened by the rivets 80. The upstream plates 60 are plural in number in order to withstand the energy of the blast gases that are produced by the circuit interrupter 8. While the exhaust control device 4 potentially could be configured in other embodiments to include only a single upstream plate having a thickness equivalent to that the of the three stacked upstream plates 60, the large number of holes 76 and the close spacing thereof would be relatively more expensive to form in a single plate than to form the same holes 76 in multiple thinner plates that are stacked. The numerous holes 76 formed in the upstream plates 60 are all of substantially the same size and give the upstream plates 60 a perforated configuration.

The downstream plate 64 is similarly formed with a plurality of openings 84 formed therein that give the downstream plate 64 a generally perforated configuration. It can be seen, however, that the downstream plate 64 additionally includes a non-perforated portion 88 that is substantially centrally disposed therein and that is slightly raised from the portion of the downstream plate 64 in which the openings 84 are formed. The non-perforated portion 88 thus provides a seat 92 against which the wall 68 is sealingly disposed.

Figure 2:
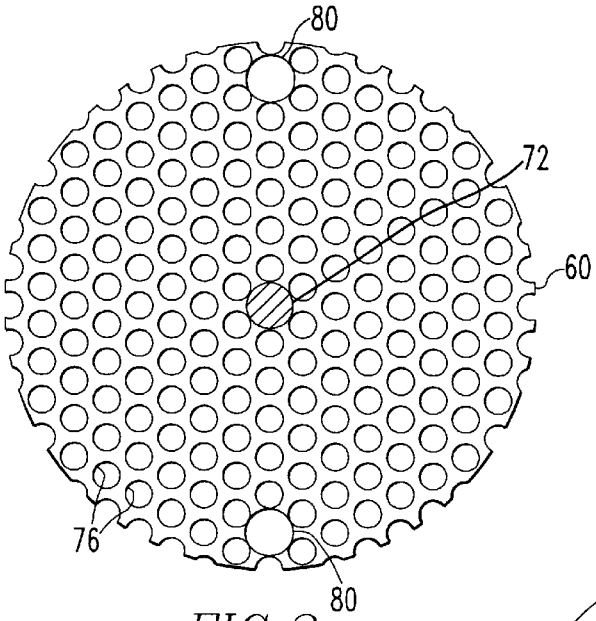
FIG. 2 is a sectional view as taken along line 2—2 of FIG. 1.
Figure 3:
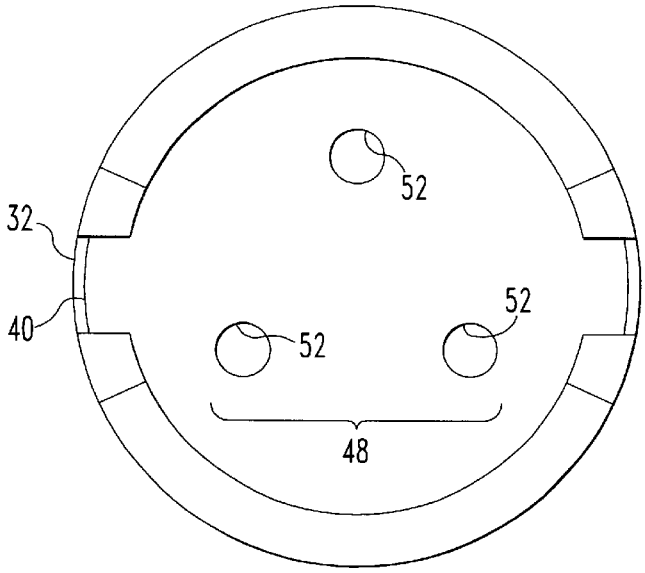
FIG. 3 is a right side elevational view of the present invention.
Figure 4:
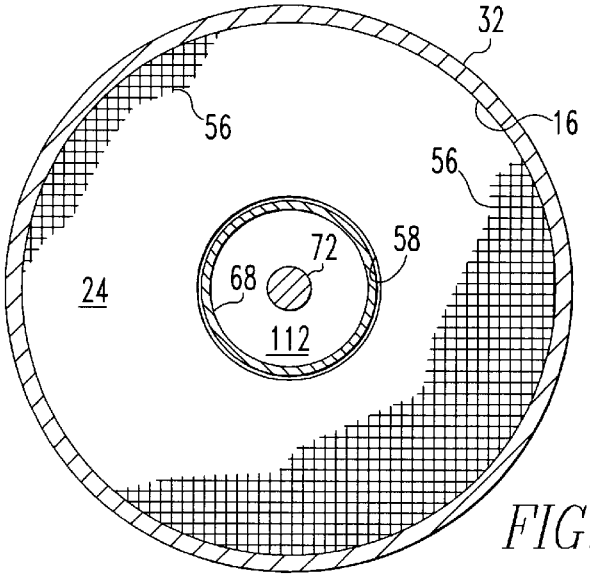
FIG. 4 is a sectional view as taken along line 4—4 of FIG. 1.

As can be understood from FIGS. 1 and 2, a relatively greater number of holes 76 are formed in the upstream plates 60 than are openings 84 formed in the downstream plates 64. As will be set forth more fully below, the relatively hot and high velocity gases that flow through the heat sink 24 are cooled and deionized and thus are reduced in intensity by the time the blast gases reach the downstream plate 64. Additionally, it is desired to provide at least a nominal back-pressure by the downstream plate 64 to reduce the velocity of the blast gases and to increase the duration of contact between the blast gases and the heat sink 24 to achieve deionization of the gases.

The wall 68 is an annular member that is made out of steel or other such appropriate material that is suited to withstand the elevated temperatures and pressures found within the exhaust control device 4. While the wall 68 is depicted as being generally circular in cross-section (FIG. 4), it will be understood from the following that the wall 68 could be of other non-circular cross-sections without departing from the concept of the present invention. As indicated above, one end of the wall 68 is sealingly disposed against the seat 92. The opposite end of the wall 68 is open and is disposed adjacent some of the holes 76 formed in the upstream plates 60.

The fastener 72 extends between the upstream plates 60 and the downstream plate 64 to retain the heat sink 24 and the wall 68 therebetween. The fastener 72 is depicted in FIG. 1 as being in the form of a bolt, although it is understood that the fastener 72 can be of other configurations such as rivets, screws, and the like. It is further understood that the upstream plates 60 could be secured in a fixed relation with respect to the downstream plate 64 by other structures such as flanges or ridges formed on the inner surface of the sidewall 32 and the like.

The damper 28 includes a retention member 96, a plurality of substantially spherical beads 100, and a diffuser 104. The damper 28 is interposed between the downstream plate 64 and the outlet plug 40, and the beads 100 of the damper 28 are substantially interposed between the retention member 96 and diffuser 104.

The retention member 96 is sheet of mesh that has been stamped or otherwise formed into a generally hat-shaped configuration to provide clearance for the fastener 72 as well as to generally retain the beads 100 around the circumference of the diffuser 104 near an annular spacer 106 that is interposed between the downstream plate 64 and the outlet plug 40. The retention member 96 is thus configured to be porous and to permit the flow of a fluid therethrough, yet retain the beads 100 against the diffuser 104 and the spacer 106.

The beads 100 are manufactured of an aluminum silicate material ($AlSiO_4$), although other materials that are suited to the temperatures and pressures of the exhaust control device may be employed. The beads 100 are at least nominally movable within the damper 28 and thus provide a tortuous path to the blast gases in flowing therethrough from the circuit interrupter 8. Further in this regard, since the beads 100 are movable, any such movement of the beads 100 by the blast of gases has the effect of dissipating some of the energy and absorbing any residual ionization of the blast, which is desirable.

The diffuser 104 is a plate of material such as metal that is formed with a number of discontinuous protrusions 108 that are engaged with the outlet plug 40 and that space the majority of the diffuser 104 away from the outlet plug 40 and provide additional tortuous paths for gases flowing from the perimeter of the diffuser 104 and out of the discharge holes 52 formed in the outlet plug 40. The diffuser 104 can be of numerous configurations but is preferably formed without holes to resist gases from flowing therethrough and directly out of the discharge holes 52, although other configurations of the diffuser 104 may be appropriate.

As can be seen from FIG. 1, the upstream plates 60 are spaced from the inlet plug 36 to provide a first expansion chamber 110 therebetween. In this regard, it can be seen that the interior 16 of the casing 12 adjacent the inlet 44 has a cross-sectional area that is substantially greater than that of the inlet 44. Accordingly, the cross-sectional area of the first expansion chamber 110 is substantially greater than that of the inlet 44. As such, the blast of gases that is initially received through the inlet 44 from the circuit interrupter 8 at least partially expands within the first expansion chamber 110, which at least nominally reduces the pressure thereof.

The exhaust control device 4 additionally and advantageously includes a second expansion chamber 112 that is disposed within the central cavity 58 of the heat sink 24 and that is in fluid communication with the first expansion chamber 110. More specifically, the second expansion chamber 112 is defined by the wall 68 and extends from a mouth 120 of the wall 68 adjacent the upstream plates 60 to the non-perforated portion 88 of the downstream plate 64. The second expansion chamber 112 is substantially cylindrical in shape, albeit with the shank of the fastener extending therethrough, and includes a central axis 116 that is centrally disposed therein and that is coaxially oriented with both the second expansion chamber 112 and the wall 68.

It can be seen that the wall 68 and thus the second expansion chamber 112 are coaxially aligned with the sidewall 32 of the casing 12, and it can particularly be seen from FIG. 1 that the central axis 116 of the second expansion chamber 112 extends through the inlet 44. In this regard, it can be seen that the mouth 120 of the second expansion chamber 112 is in register with the inlet 44, meaning that the mouth 120 and the inlet 44 are aligned with one another along the direction in which the blast of gases from the circuit interrupter 8 initially flows through the inlet 44.

Further in this regard, it can be seen that when the blast of gases from the circuit interrupter 8 flows through the inlet 44, a first portion of the blast gases flow and expand into the first expansion chamber 110, and advantageously a second portion of the blast gases flow through the holes 76 in the upstream plates 60 and into the second expansion chamber 112 where such second portion of the blast gases are permitted to expand. As a result, immediately after the blast of gases has been received through the inlet 44, at most only the first portion of the blast gases is disposed within the first expansion chamber 110 inasmuch as the second portion of the blast gases is disposed in the second expansion chamber 112.

In operation, prior to the production of the blast of gases by the circuit interrupter 8, the exhaust control device 4 is generally at ambient temperature, as set forth above. When a specified electrical condition occurs within the circuit interrupter 8, the circuit interrupter 8 generates a blast of gases that may include water vapor and inert boric anhydride, and the blast of gases is received through the inlet 44 and into the interior 16 of the exhaust control device 4. More specifically, the first portion of the blast of gases expands within the first expansion chamber 112, and substantially simultaneously therewith the second portion of the blast of gases flows directly from the inlet 44, across the first expansion chamber 110, and through the holes 76 in the upstream plates 60 into the second expansion chamber 112. Since the mouth 120 of the second expansion chamber 112 is in register with the inlet 44, the momentum of the blast of gases causes a substantial proportion of the blast gases to flow directly into the second expansion chamber 112 and to become the aforementioned second portion.

Inasmuch as the mouth 120 of the second expansion chamber 112 is disposed substantially at the downstream end of the first expansion chamber 110 and opposite the inlet 44, and since the non-perforated portion 88 of the downstream plate 64 is spaced substantially the length of the wall 68 from the mouth 120, in flowing from the inlet 44 to the non-perforated portion 88 the second portion of the blast gases flows a substantially longer distance than the first portion of the blast gases that merely expand within the first expansion chamber 110. Accordingly, it can be seen that the second portion of the blast gases is initially flowing longitudinally through the second expansion chamber 112 away from the inlet 44 while the first portion of the blast gases is flowing through the holes 76 in the upstream plates 60 and into and through the heat sink 24.

It can be understood from FIG. 1 that at approximately the same time that the first portion of the blast gases flowing through the mesh 56 of the heat sink 24 is reaching the downstream plate 64, the second portion of the blast gases is substantially simultaneously reaching the non-perforated portion 88 of the downstream plate 64. In this regard, it is understood that since the second expansion chamber 112 is substantially unobstructed, the second portion of the blast gases likely will reach the non-perforated portion 88 at least nominally faster than the first portion of the blast gases traveling through the heat sink 24 will reach the downstream plate 64.

When the second portion of the blast gases has expanded into the second expansion chamber 112 and has reached the non-perforated portion 88, a substantial part of the first portion of the blast gases will have already traveled into the heat sink 24, and the pressure within the first expansion chamber 110 will have been correspondingly substantially reduced. As such, the second portion of the blast gases that is disposed in the second expansion chamber 112 flows back out of the second expansion chamber 112 through the holes 76 in the upstream plates 60 and into the first expansion chamber 110, after which the second portion of the blast gases flows through the holes 76 in the upstream plates 60 and into the heat sink 24. While the second expansion chamber 112 is physically disposed within the heat sink 24, it can be seen that the second expansion chamber 112 is operationally disposed upstream of the heat sink 24 since the second portion of the blast gases must return and flow through the first expansion chamber 110 in order to flow into the heat sink 24.

It thus can be seen that by providing the second expansion chamber 112, the blast of gases can be generally divided into (i) a first pressure wave that initially expands into the first expansion chamber and thereafter immediately into the heat sink 24 and (ii) a second pressure wave that flows directly into and expands into the second expansion chamber 112 prior to flowing back into the first expansion chamber 110 and into the heat sink 24. As such, by providing the exhaust control device 4 with the second expansion chamber 112 in fluid communication with the first expansion chamber 110, the heat sink 24 and the damper 28 are each sequentially subjected to the first and second pressure waves, each of which are of a lower intensity or pressure than the initial blast of gases. This provides the advantageous result that the heat sink 24 and the damper 28 are subjected to a net flow of gases having an overall reduced intensity but of a greater duration, which beneficially reduces the wear and tear on the heat sink 24 and the damper 28, and increases the deionization of the gases passing through these devices.

Figure 5:
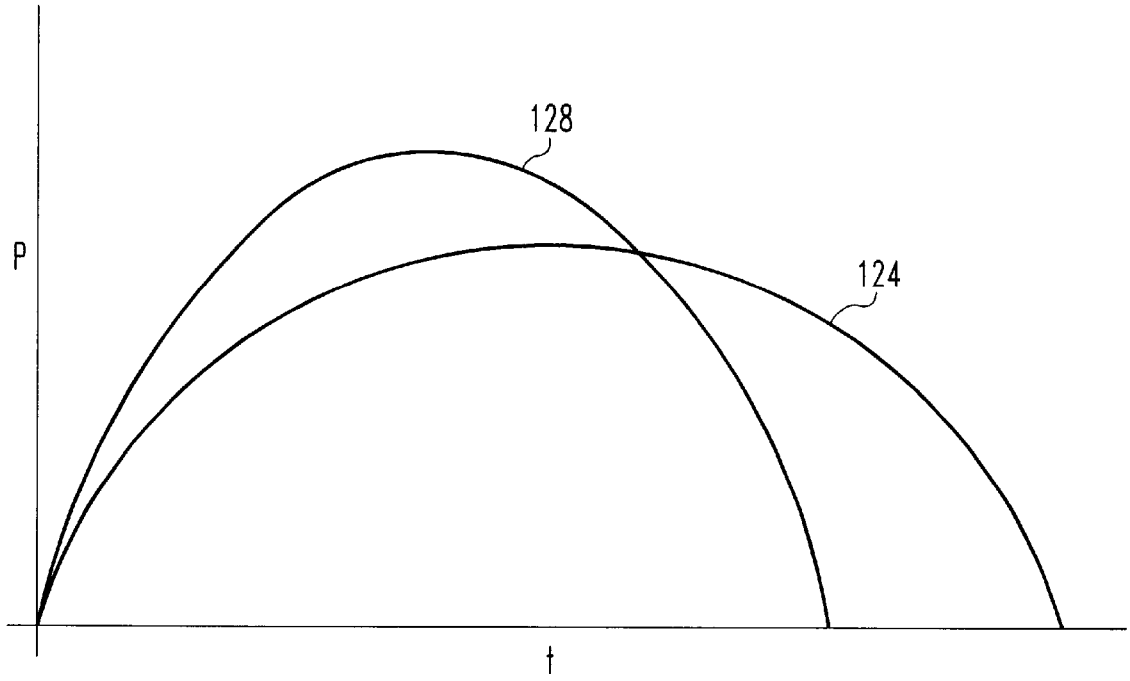
FIG. 5 is a schematic representation of the pressure curves experienced by the present invention and by a previously known exhaust control device when each is subjected to the same blast of gases from the circuit interrupter.

FIG. 5 schematically depicts at the numeral 124 the net pressure curve resulting from a blast of gases that is experienced by the heat sink 24 and the damper 28 as a function of time. FIG. 5 additionally schematically depicts at the numeral 128 a hypothetical pressure curve resulting from the same blast of gases that would be experienced by the heat sink 24 and the damper 28 in the absence of the second expansion chamber 112. As can be seen in FIG. 5, the first curve 124 is of a lesser peak intensity and is of a greater duration than the second curve 128, although the areas under each of the first and second curves 124 and 128 are substantially equal. Accordingly, it can be seen that by providing the second expansion chamber 112 and reducing the peak intensity of the blast gases flowing through the heat sink 24 and the damper 28, a relatively smaller heat sink 24 can be provided, meaning that the heat sink 24 is of a shorter distance between the upstream and downstream plates 60 and 64 than previously known exhaust control devices, while still providing the same level of cooling, velocity reduction, and deionization to the blast gases exiting the outlet 48.

As the first and second pressure waves of the blast gases pass through the holes 76 in the upstream plates 60 and into the heat sink 24, the blast gases are cooled and deionized as they flow through the numerous pores in the mesh 56 and flow over the metal strands of the mesh 56 that had initially been at ambient temperature. In so doing, the blast gases cool, and the metal vapor initially present in the blast gases from the fusing of the element condenses onto the mesh 56. Such cooling and condensation has the effect of reducing the volume, velocity, and ionization level of the blast gases. Additionally, the tiny pores in the mesh provide a tortuous path through which the blast gases must travel, which additionally reduces their velocity.

The blast gases thereafter flow through the openings 84 in the downstream plate 64, through the mesh of the retention member 96, and into the beads 100. The blast gases flow through the beads 100, around the radially outermost edge of the diffuser 104, through the narrow space between the diffuser 104 and the outlet plug 40, around the protrusions 108 of the diffuser 104, and out of the discharge holes 52. The heat sink 24 and the damper 28 thus each provide a tortuous path through which the blast of gases must travel prior to reaching the outlet 48.

By positioning the second expansion chamber 112 in register with the inlet 44, a substantial second portion of the blast gases flows into the second expansion chamber 112 and substantially reduces the peak intensity or pressure of the blast gases. By reducing the peak intensity of the blast gases flowing through the heat sink 24 and damper 28, relatively less wear and tear is caused to the heat sink 24 and damper 28, which correspondingly gives the exhaust control device 4 a longer life. In this regard, the term "longer life" refers to a greater number of times that the exhaust control device 4 can be subjected to a blast of gases from a circuit interrupter 8 prior to needing replacement. Previously known exhaust control devices were typically able to withstand five or six blasts from a circuit interrupter 8, and the exhaust control device 4 of the present invention is able to withstand ten or more such blasts. Additionally, as indicated above the exhaust control device 4 can be manufactured less expensively than previously known exhaust control devices because the exhaust control device 4 does not requires as large a heat sink.

The cross-sectional area of the heat sink 24 may be in the range of about 70% to 80% of the cross-sectional area of the interior 16. The cross-sectional area of the second expansion chamber 112 may be in the range of about 20% to 30% of the cross-sectional area of the interior 16. In this regard, it is understood that the specific cross-sectional shape of the wall 68 and of the second expansion chamber 112 are relatively unimportant so long as the mouth 120 of the second expansion chamber 112 is in register with the inlet 44. By aligning the mouth 120 of the second expansion chamber 112 with the flow path of the blast gases as they flow through the inlet 44 of the exhaust control device 4, the second portion of the blast gases is permitted to flow into the second expansion chamber 112 where it forms the second pressure wave of the blast gases. It is noted that the first curve 124 does not specifically depict separate pressure peaks for the first and second pressure waves, it being understood that the first curve 124 is a schematic representation of the overall pressure experienced by the heat sink 24 and the damper 28.

As such, by configuring the exhaust control device 4 to include the first expansion chamber 110 disposed at the inlet 44 as well as the second expansion chamber 112 in register with the inlet 44, the intensity of the blast gases to which the heat sink 24 and the damper 28 are subjected is reduced, with the effect that the exhaust control device can be manufactured relatively less expensively, is relatively small in size without adversely affecting the performance thereof, and has a longer life. The exhaust control device 4 of the present invention thus provides advantages heretofore unknown in the relevant art.

While specific embodiments of the invention have been described in detail, it will be appreciated by those skilled in the art that various modifications and alternatives to those details could be developed in light of the overall teachings of the disclosure. Accordingly, the particular arrangements disclosed are meant to illustrative only and not limiting as to the scope of invention which is to be given the full breadth of the claims appended and any and all equivalents thereof.

What is claimed is:

1. An exhaust control device for use in conjunction with a circuit interrupter, the exhaust control device comprising:

a casing having an interior and including an inlet and an outlet in flow communication with the interior, the inlet being structured to be connected in fluid communication with the circuit interrupter;

a support apparatus disposed within the interior;

a wall disposed within the interior of the casing and mounted on the support apparatus;

a porous heat sink disposed within the interior of the casing between the inlet and the outlet and extending at least partially around the wall between the wall and the casing, the heat sink being structured to permit the flow of fluid therethrough;

a first expansion chamber disposed within the interior at least partially between the inlet and the heat sink, the first expansion chamber having a greater cross-sectional area than the inlet; and a second expansion chamber defined by the wall and in fluid communication with the first expansion chamber, the second expansion chamber having a mouth that is in register with at least a portion of the inlet.

2. The exhaust control device as set forth in claim 1, in which the second expansion chamber is substantially centrally disposed within the heat sink.

3. The exhaust control device as set forth in claim 1, in which the support apparatus includes a perforated upstream plate and an at least partially perforated downstream plate, the wall and the heat sink being substantially interposed between the upstream and downstream plates.

4. The exhaust control device as set forth in claim 3, in which the support apparatus includes a fastener extending between the upstream and downstream plates and extending through the second expansion chamber.

5. The exhaust control device as set forth in claim 3, in which the downstream plate includes a non-perforated portion that is engaged with the wall and that at least partially defines the second expansion chamber, the non-perforated portion being disposed opposite the mouth of the second expansion chamber.

6. The exhaust control device as set forth in claim 1, in which the first expansion chamber extends across substantially the entire cross-sectional area of the interior of the casing, in which the heat sink extends across a region in the range of about 70% to 80% of the cross-sectional area of the interior, and in which the second expansion chamber extends across a region in the range of about 20% to 30% of the cross-sectional area of the interior.

7. An exhaust control device for use in conjunction with a circuit interrupter, the exhaust control device comprising:

a casing having an interior and including an inlet and an outlet in flow communication with the interior, the inlet being structured to be connected in fluid communication with the circuit interrupter;

a support apparatus disposed within the interior;

a porous heat sink disposed within the interior of the casing between the inlet and the outlet, the heat sink being structured to permit the flow of fluid therethrough;

a first expansion chamber disposed within the interior at least partially between the inlet and the heat sink, the first expansion chamber having a greater cross-section than the inlet;

a second expansion chamber disposed inside the heat sink and being in fluid communication with the first expansion chamber; and the second expansion chamber having a mouth that is in register with at least a portion of said inlet.

* * * * *